US011302496B2

(12) United States Patent
Anderson et al.

(10) Patent No.: US 11,302,496 B2
(45) Date of Patent: Apr. 12, 2022

(54) DRAINAGE ASSEMBLY

(71) Applicant: WHIRLPOOL CORPORATION, Benton Harbor, MI (US)

(72) Inventors: Brianne Nicole Anderson, St. Joseph, MI (US); Homprakash Hariharan, Maharashtra (IN); Sadasivam Narayanan, Maharashtra (IN); Ganesan Ravi, Tamil Nadu (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/826,351

(22) Filed: Mar. 23, 2020

(65) Prior Publication Data

US 2021/0296064 A1 Sep. 23, 2021

(51) Int. Cl.

| | |
|---|---|
| ***H01H 19/06*** | (2006.01) |
| ***G05G 1/10*** | (2006.01) |
| ***G05G 1/12*** | (2006.01) |
| ***H01H 19/54*** | (2006.01) |
| ***G05G 25/00*** | (2006.01) |

(52) U.S. Cl.

CPC ..... *H01H 19/06* (2013.01); *G05G 1/10* (2013.01); *G05G 1/12* (2013.01); *G05G 25/00* (2013.01); *H01H 19/54* (2013.01); *H01H 2231/012* (2013.01)

(58) Field of Classification Search

CPC ..... H01H 19/06; H01H 3/08; H01H 19/04; H01H 19/14; G05G 1/10; G05G 1/12; G05G 25/00

USPC .... 200/296, 293, 294, 302.1, 336, 564, 567, 200/11 r

See application file for complete search history.

(56) References Cited

U.S. PATENT DOCUMENTS

| | | | | |
|---|---|---|---|---|
| 4,837,413 | A | 6/1989 | Schwab et al. | |
| 6,204,459 | B1 | 3/2001 | Kizele et al. | |
| 8,049,121 | B2 | 11/2011 | Kleinlein et al. | |
| 10,318,078 | B2 | 6/2019 | Okuzumi et al. | |
| 2007/0119484 | A1* | 5/2007 | Kwon | D06F 34/32 134/58 R |
| 2014/0021024 | A1* | 1/2014 | Heimann | H01H 25/06 200/4 |
| 2019/0285281 | A1 | 9/2019 | Neillaiappan et al. | |
| 2019/0330788 | A1 | 10/2019 | Yun | |

FOREIGN PATENT DOCUMENTS

| | | | |
|---|---|---|---|
| JP | 63226542 | A | 9/1988 |
| JP | 05329293 | A | 12/1993 |
| KR | 101234033 | B1 | 2/2013 |
| KR | 101416696 | B1 | 7/2014 |

* cited by examiner

*Primary Examiner* — Edwin A. Leon
*Assistant Examiner* — Iman Malakooti
(74) *Attorney, Agent, or Firm* — Price Heneveld LLP

(57) ABSTRACT

A user interface includes a front panel that has an exterior surface and an interior surface. A flange outwardly extends from the exterior surface and defines a notch. A receiving body extends from the interior surface of the front panel that is proximate the flange. A receiving body has an angled edge and defines a drainage channel that extends through a portion of the notch that is defined by the flange.

19 Claims, 8 Drawing Sheets

DRAINAGE ASSEMBLY

BACKGROUND OF THE DISCLOSURE

The present disclosure generally relates to an appliance, and more specifically, to a drainage assembly for an appliance.

SUMMARY OF THE DISCLOSURE

According to one aspect of the present disclosure, an appliance includes a user interface that has a first surface and an opposing second surface. A flange outwardly extends from the first surface. A receiving body extends from the opposing second surface and defines an encoder opening and a drainage channel. An electromechanical switch has an encoder that extends through the encoder opening that is defined by the receiving body. A knob is operably coupled to the electromechanical switch via the encoder. The knob defines a receiving cavity, and a locking feature is disposed within the receiving cavity and secures the knob to the encoder.

According to another aspect of the present disclosure, a user interface includes a front panel that has an exterior surface and an interior surface. A flange outwardly extends from the exterior surface and defines a notch. A receiving body extends from the interior surface of the front panel that is proximate the flange. A receiving body has an angled edge and defines a drainage channel that extends through a portion of the notch that is defined by the flange.

According to yet another aspect of the present disclosure, a user interface for an appliance includes a panel that has a first surface and an opposing second surface. A drainage assembly is coupled to the panel and extends from the first surface and the opposing second surface. The drainage assembly includes a receiving body that defines an opening and a drip edge. An encoder extends through the opening of the drainage assembly. A knob is operably coupled to the encoder and has a cavity. A locking feature is disposed within the cavity.

These and other features, advantages, and objects of the present disclosure will be further understood and appreciated by those skilled in the art by reference to the following specification, claims, and appended drawings.

Figure 1:
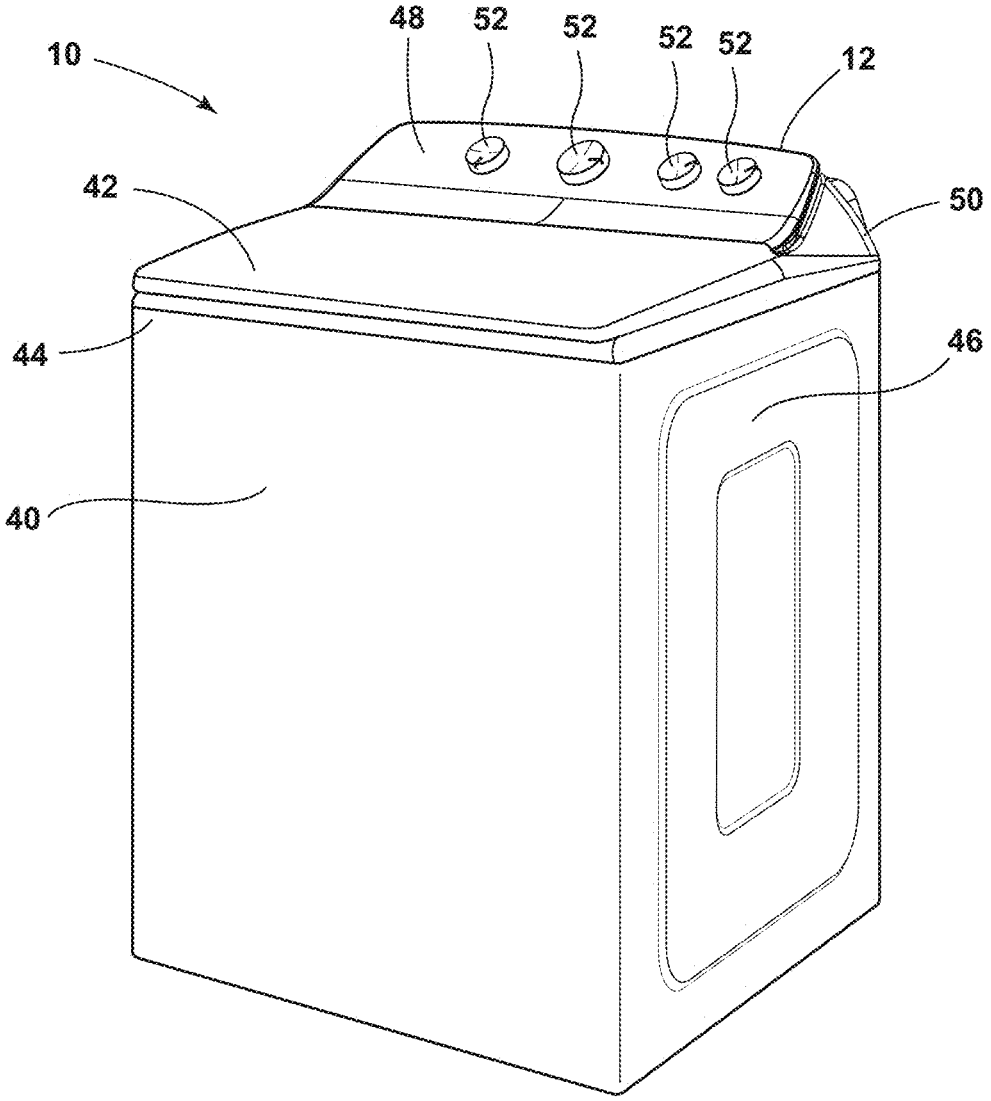
FIG. 1 is a front perspective view of an appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a drainage assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-9, reference numeral 10 generally designates an appliance that includes a user interface 12 that has a first surface 14 and an opposing second surface 16. A flange 18 outwardly extends from the first surface 14, and a receiving body 20 extends from the opposing second surface 16. The receiving body 20 defines an encoder opening 22 and a drainage channel 24. An electromechanical switch 26 has an encoder 28 that extends through the encoder opening 22 defined by the receiving body 20. A knob 30 is operably coupled to the electromechanical switch 26 via the encoder 28 and defines a receiving cavity 32. A locking feature 34 is disposed within the receiving cavity 32 and secures the knob 30 to the encoder 28.

Referring to FIG. 1, the appliance 10 includes a body 40 with a door 42 coupled to the body 40. As depicted, the appliance 10 is a top-load washer. However, it is also contemplated that the appliance 10 may be other appliances including, but not limited to, a dishwasher, stove, a dryer, and other appliances known in the art that can use and/or incorporate the user interface 12, as described herein. Furthermore, although illustrated as a top-load laundry appliance, the appliance 10 may also be a front-load laundry appliance, such that the door 42 may be a flat panel door, a fishbowl style door, or a combination thereof. The door 42, as illustrated in FIG. 1, opens in an up-and-down manner; however, it is contemplated that the door 42 may open in a side-to-side manner. An exterior 44 of the body 40 may be defined by an outer casing 46 of the body 40.

Additionally, the first surface 14 of the user interface 12 can be defined as an exterior surface relative to the exterior 44 of the body 40, and the opposing second surface 16 can be defined as an interior surface of the user interface 12. Moreover, the user interface 12 includes a front panel 48 that further defines the exterior surface 14 and the interior surface 16, such that the interior surface 16 is an opposing surface to the exterior surface 14. The front panel 48 is coupled to a frame 50 of the user interface 12. As illustrated, the front panel 48 of the user interface 12 is generally sloped or angled relative to the body 40 of the appliance 10, such that user controls 52 are generally disposed at an angle relative to the body 40 of the appliance 10. The user controls 52 include the knob 30, which is operably coupled to the electromechanical switch 26, described in further detail below. Because of the angled configuration of the front panel 48, fluid, typically water and/or laundry chemistry, can flow along the exterior surface 14 or the interior surface 16 of the front panel 48. Redirection of this fluid to avoid contact with various controls is described below.

Figure 2:
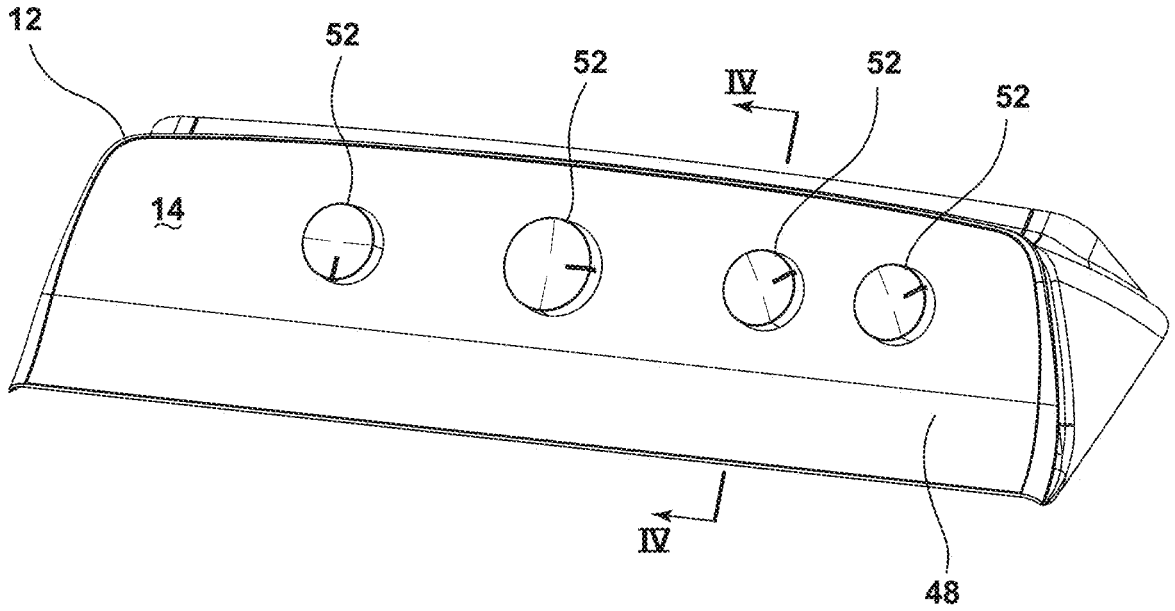
FIG. 2 is a top perspective view of a user interface of the present disclosure with control knobs.
Figure 3:
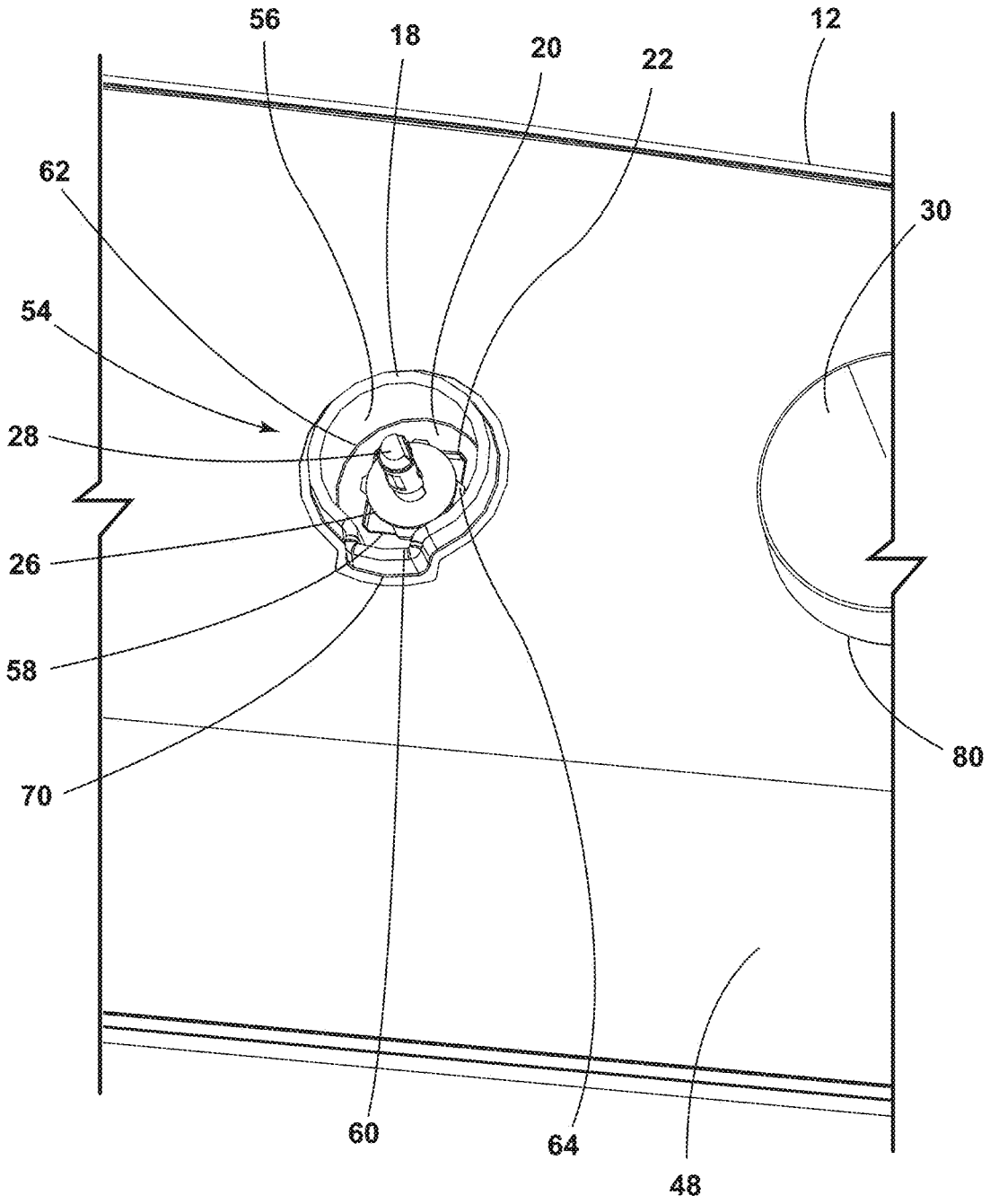
FIG. 3 is an enlarged partial top perspective view of the user interface of FIG. 2, without one of the knobs removed to show a drainage assembly of the present disclosure.
Figure 4:
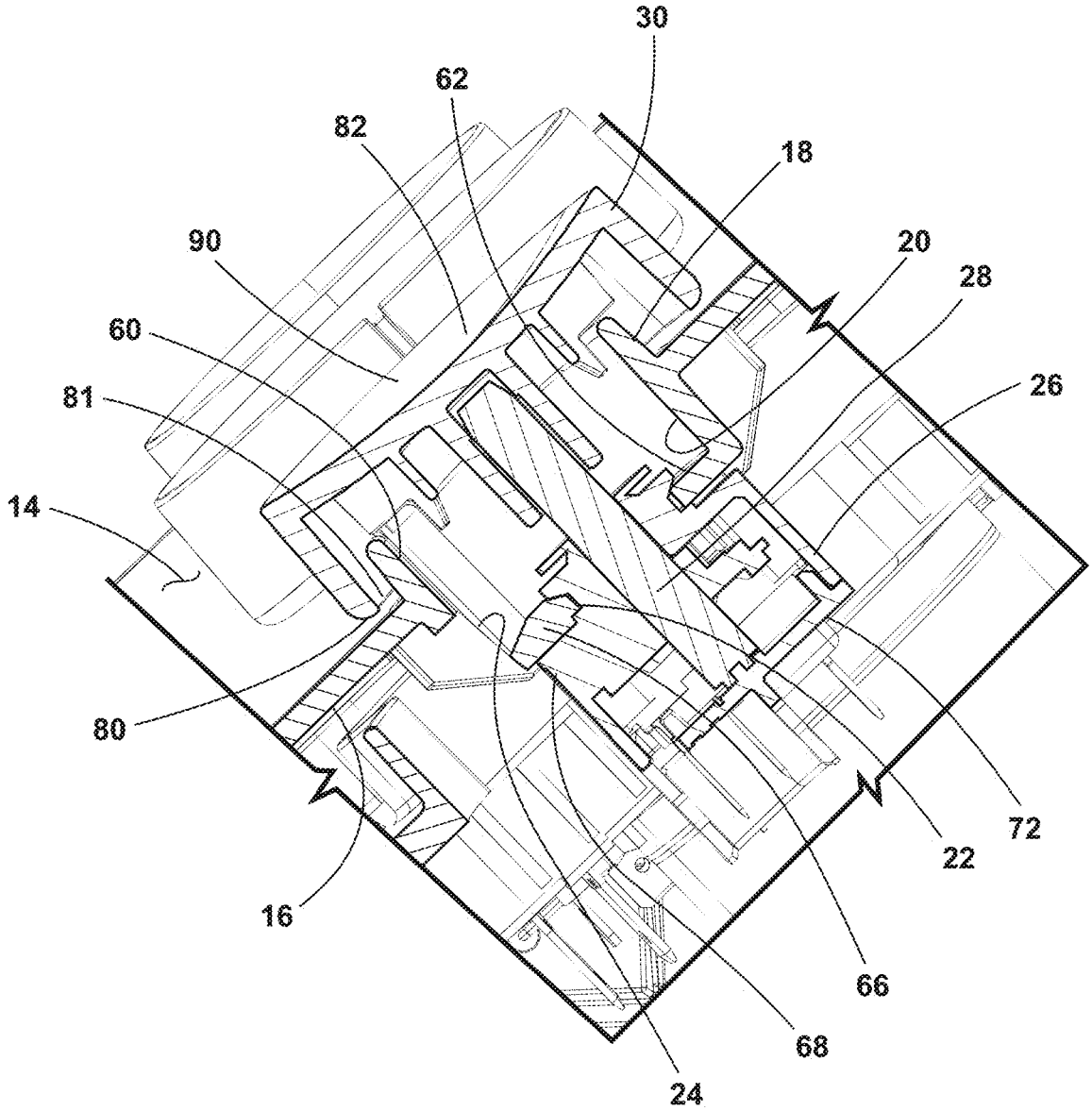
FIG. 4 is a cross-sectional side perspective view of the user interface of FIG. 2 taken along the line IV-IV.

Referring now to FIGS. 2-4, the front panel 48 generally defines a drainage assembly 54, which includes the flange 18 and the receiving body 20 of the user interface 12. In general, the drainage assembly 54 extends from both the exterior surface 14 and the interior surface 16. Stated differently, the flange 18 extends from the exterior surface 14, and the receiving body 20 extends from the interior surface 16. It is generally contemplated that the flange 18 and the receiving body 20 can be integrally formed to define the drainage assembly 54. Additionally or alternatively, the receiving body 20 and the flange 18 may be separately formed and individually coupled to the interior surface 16 and the exterior surface 14 of the front panel 48, respectively. The drainage assembly 54 can have a circumferential sidewall 56 that defines the flange 18 and the receiving body 20. In addition, the circumferential sidewall 56 can also define a passage 58 that extends to the drainage channel 24 of the receiving body 20. In addition, the flange 18 defines a notch 60, which may also direct the fluid into the drainage channel 24 of the receiving body 20. Accordingly, it is generally contemplated that the notch 60 may correspond with the passage 58 defined by the circumferential sidewall 56. The flange 18 and the circumferential sidewall 56 may both direct fluid from the flange 18 toward the drainage channel 24 of the receiving body 20.

As generally described above, the receiving body 20 defines the encoder opening 22, through which the encoder 28 extends. The encoder opening 22 is generally defined by a base 62 of the receiving body 20 proximate to the drainage channel 24. As illustrated in FIGS. 3 and 4, the base 62 includes a perimeter edge 64 that defines the encoder opening 22, such that, in addition to the encoder 28, a portion of the electromechanical switch 26 extends through the encoder opening 22 and partially engages the perimeter edge 64. The at least partial engagement of the electromechanical switch 26 with the perimeter edge 64 of the base 62 at least partially retains the electromechanical switch 26, and the encoder 28, within the receiving body 20. Thus, the electromechanical switch 26 is coupled to the user interface 12 via the base 62 of the receiving body 20.

With further reference to FIGS. 3 and 4, the receiving body 20 also defines a drip edge 66, which is disposed within the drainage channel 24. The drip edge 66 extends beyond the electromechanical switch 26, such that the fluid directed from the flange 18 into the receiving body 20 enters the drainage channel 24 and also runs along the drip edge 66. The drip edge 66 is configured to minimize fluid contact with the electromechanical switch 26 of any fluid that may enter the receiving body 20 of the drainage assembly 54. As such, the drip edge 66 is angled to direct the fluid from the receiving body 20 away from the electromechanical switch 26.

The drip edge 66 also extends beyond a surface 68 of the electromechanical switch 26, such that the fluid from the flange 18 flows through the drainage channel 24 and is directed, or angled, away from the electromechanical switch 26 by the drip edge 66 and, ultimately, gravitational force. The drip edge 66 may also be referred to as an angled edge of the receiving body 20. The drip edge 66 is disposed below the encoder opening 22, such that the drip edge 66 is generally positioned beneath and/or below the encoder 28. By being positioned below the encoder 28, the drip edge 66 minimizes the potential for fluid contact with the electromechanical switch 26, which could result in malfunction or damage.

As mentioned above, the notch 60 of the flange 18 extends toward the drip edge 66 to at least partially define the drainage channel 24. Additionally or alternatively, the passage 58 defined by the circumferential sidewall 56 similarly extends to the drip edge 66 to at least partially define the drainage channel 24. Both the passage 58 and the notch 60 may have a directing geometry, such that the passage 58 and/or the notch 60 may be generally angled to have a crest 70 to further direct and funnel the fluid from the flange 18 through the notch 60 and/or the passage 58 toward the drainage channel 24.

Referring still to FIGS. 3 and 4, the drainage channel 24 is defined between the drip edge 66 and the notch 60 of the flange 18 and the receiving body 20. In general, fluid is directed along the notch 60 and into the drainage channel 24, such that the fluid minimally contacts the base 62 of the receiving body 20. To further minimize contact with the electromechanical switch 26, the notch 60 and, ultimately, the drainage channel 24 are respectively disposed and defined to extend proud of the electromechanical switch 26. Moreover, the portion of the electromechanical switch 26 that extends through the encoder opening 22 is typically minimally affected by fluid contact, such that any potential fluid within the receiving body 20 would have minimal impact upon contact with that portion of the electromechanical switch 26.

The electrical components of the electromechanical switch 26 are contained within a housing 72 of the electromechanical switch 26 behind the interior surface 16 and the receiving body 20 of the user interface 12. The housing 72 engages the perimeter edge 64 around the encoder opening 22 to hold the housing 72 in place. The housing 72 of the electromechanical switch 26 is covered by the base 62 of the receiving body 20 to protect the electrical components of the electromechanical switch 26 from coming into contact with fluid. This protection is further achieved by the positioning of the drip edge 66 beyond the housing 72 of the electromechanical switch 26 as well as the notch 60 and the drainage channel 24 being positioned beyond the surface 68 of the electromechanical switch 26 that may otherwise come into contact with the fluid. For example, the housing 72 helps to direct fluid toward the drip edge 66, away from the electromechanical switch 26. The ingress of fluid toward the electromechanical switch 26 is further minimized by the knob 30 disposed on the exterior surface 14 of the user interface 12. Once directed away from the electromechanical switch 26, the fluid generally is disposed on a top surface of the body 40 (FIG. 1) of the appliance 10 (FIG. 1) and, ultimately, drains through console mounting slots defined in the body 40 (FIG. 1).

Figure 5:
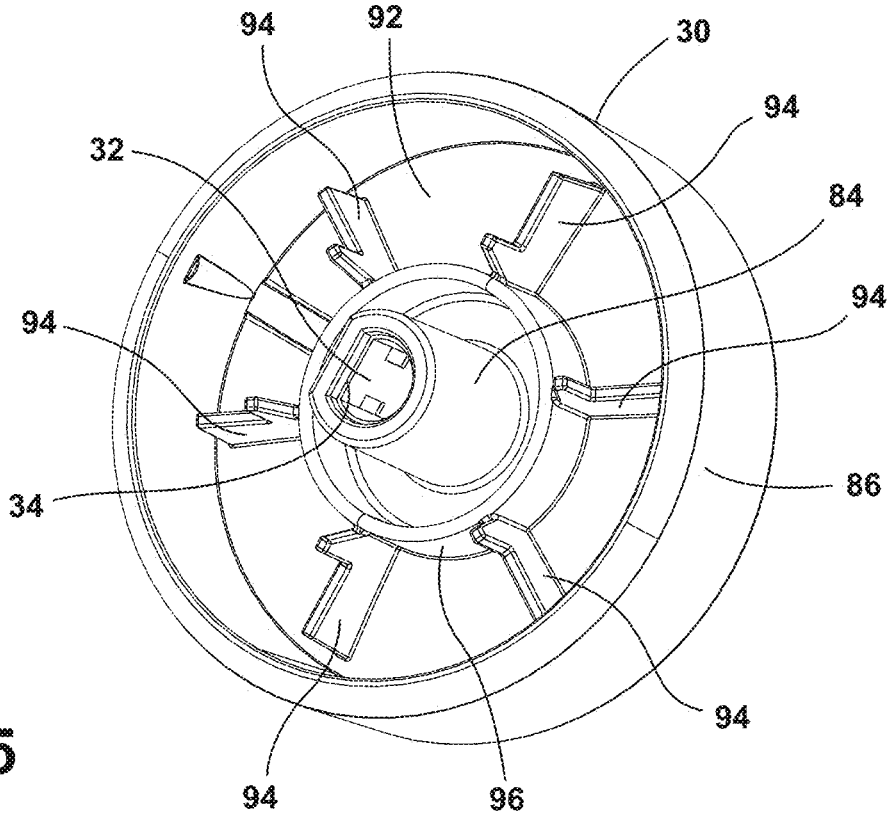
FIG. 5 is a rear perspective view of a knob of the present disclosure with a cap and a stem.
Figure 6:
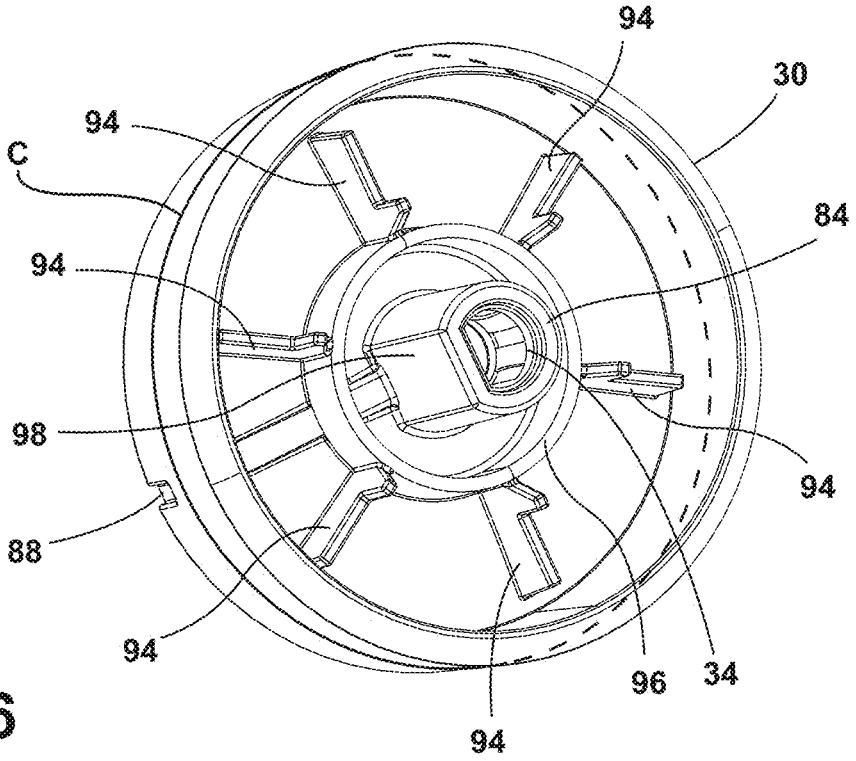
FIG. 6 is a rear perspective view of the knob of FIG. 5 showing a locking feature of the present disclosure.
Figure 7:
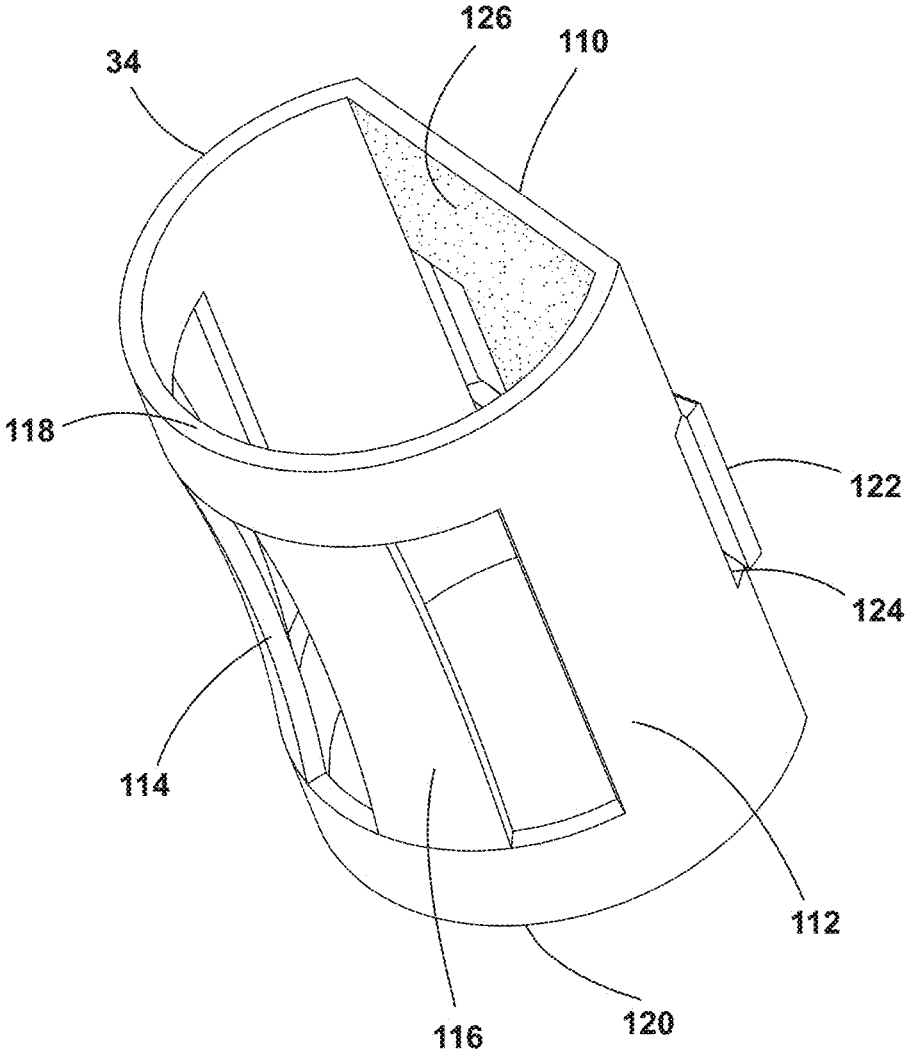
FIG. 7 is a top perspective view of a locking feature of the present disclosure.

Referring to FIGS. 5-7, the user interface 12 includes the user controls 52, as mentioned above. Each of the user controls 52 includes the knob 30, which is operably coupled to the electromechanical switch 26 via the encoder 28. The knob 30 may generally encircle the flange 18, such that the knob 30 and the flange 18 define a barrier 80 typically in the form of a labyrinth, between the knob 30 and the exterior surface 14 and the receiving body 20. Accordingly, while mentioned above that fluid may enter the receiving body 20 from the flange 18, it is generally contemplated that such fluid is likely the result of condensation build-up within the drainage assembly 54, rather than splashed fluid or fluid otherwise directly applied to the exterior surface 14 of the user interface 12. While the barrier 80 minimizes the potential for liquid ingress toward the electromechanical switch 26, a gap 81 is defined between the knob 30 and the front panel 48, so the knob 30 and the encoder 28 are actionable relative to the front panel 48.

The knob 30 includes a cap 82 and a stem 84 in which the receiving cavity 32 can be defined. It is generally contemplated that the cap 82 can be integrally formed with the stem 84 to form the knob 30. Additionally or alternatively, the stem 84 may be coupled to the cap 82 to form the knob 30. The cap 82 includes a collar 86 that defines a circumference C of the knob 30 and is the portion of the knob 30 that defines the barrier 80. The gap 81, mentioned above, is defined between the collar 86 and the exterior surface 14 of the front panel 48, such that a user may press upon the cap 82 to minimize the gap 81 between the collar 86 and the exterior surface 14 to rotate the knob 30 and the encoder 28. In addition, an indicator 88 is defined on a face 90 of the cap 82 to indicate the position of the knob 30 as it is rotated, typically indicating a particular setting of the appliance 10 (FIG. 1). The indicator 88 may be indented, extended, or aesthetically applied to the face 90 to also be defined by the collar 86 of the cap 82. As depicted, a rear surface 92 of the cap 82 includes a plurality of support ribs 94, which may provide structural support for the cap 82 including attaching to a central ring 96 within which the stem 84 is disposed. The central ring 96 can be used to further define the barrier 80.

With further reference to FIGS. 5-7, the stem 84 is coupled to the rear surface 92 of the cap 82. As illustrated, the stem 84 has a D-shaped configuration, such that the typical D-shape of the encoder 28 is configured to fit within the stem 84 in a single rotational orientation. For example, the stem 84 includes a flat surface 98, which generally aligns with the indicator 88 defined by the cap 82. This arrangement minimizes potential rotation of the encoder 28 within the stem 84 when the knob 30 is rotated to a selected setting of the appliance 10 (FIG. 1). The knob 30 is coupled to the encoder 28 to rotatably engage the electromechanical switch 26 to generally operate the appliance 10 (FIG. 1). The encoder 28 is positioned within the receiving cavity 32 of the knob 30, which is defined by the stem 84. To secure the encoder 28 within the stem 84, the locking feature 34 is disposed within the receiving cavity 32 defined by the stem 84 and the knob 30. Additionally or alternatively, the locking feature 34 may be integrally formed with the stem 84, such that the locking feature 34 and the stem 84 both define the receiving cavity 32 of the knob 30.

Figure 8:
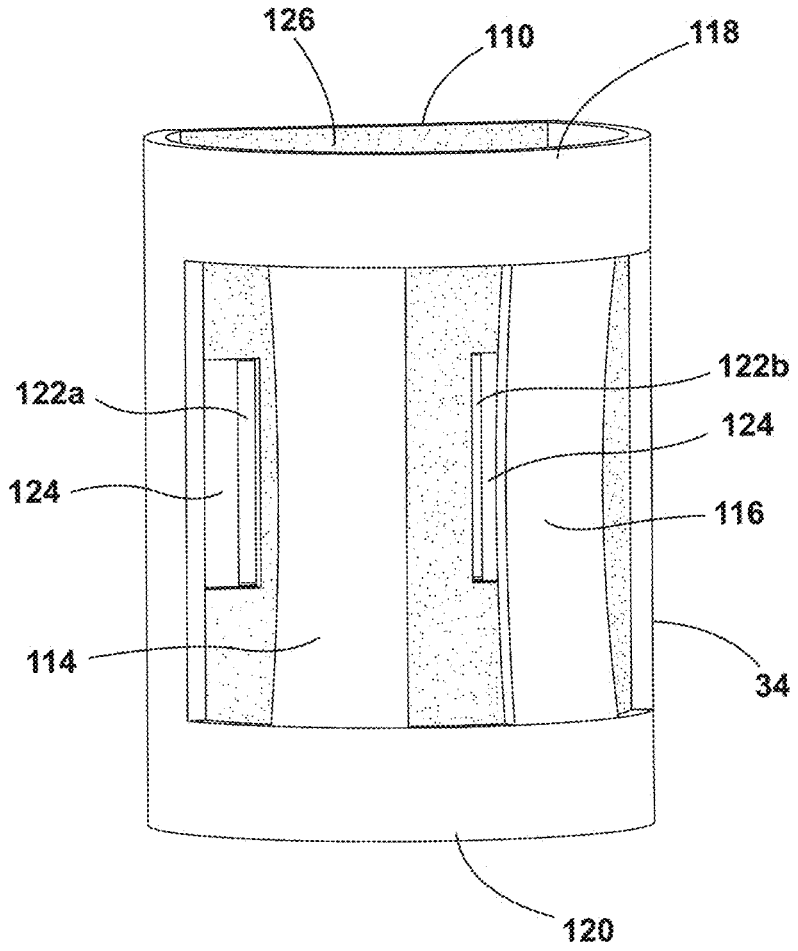
FIG. 8 is a side perspective view of the locking feature of FIG. 7 and showing an aspect of resilient ribs of the present disclosure.

Referring now to FIGS. 6-9, the locking feature 34 includes a planar surface 110 and an arcuate surface 112. The planar surface 110 of the locking feature 34 generally corresponds with the flat surface 98 of the stem 84. The arcuate surface 112 includes a first resilient rib 114 and a second resilient rib 116, as illustrated in FIG. 8. It is also contemplated that the arcuate surface 112 may have a single resilient rib 114 and/or a plurality of resilient ribs defined along the arcuate surface 112. Each of the first and second resilient ribs 114, 116 are defined between a first rim 118 and a second rim 120 of the arcuate surface 112. The first and second resilient ribs 114, 116 are generally bowed between the first and second rims 118, 120, such that when the encoder 28 is removed from the locking feature 34 the generally bowed construction of the first and second resilient ribs 114, 116 is defined.

Figure 9:
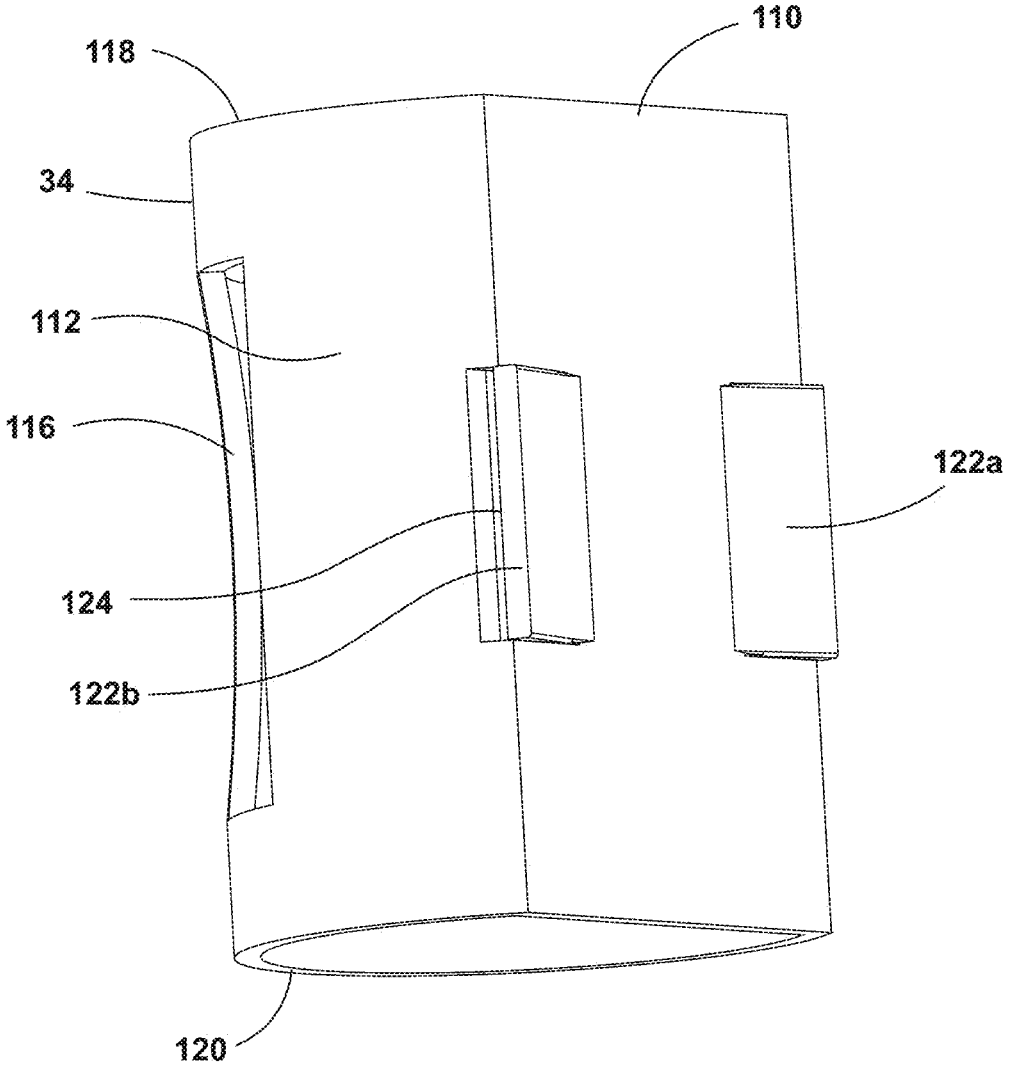
FIG. 9 is a side perspective view of the locking feature of FIG. 7 and showing an aspect of locking projections of the present disclosure.

Once the encoder 28 is positioned within the locking feature 34 and the receiving cavity 32 of the stem 84, the first and second resilient ribs 114, 116 are biased by the encoder 28 toward the stem 84 to define a generally rigid construction of the first and second resilient ribs 114, 116. In addition, the planar surface 110 defines at least one locking projection 122 that outwardly extends from the planar surface 110. The at least one locking projection 122 can include a first locking projection **122*a* and a second locking projection 122*b*. As illustrated in FIGS. 7-9, each of the first and second locking projections 122*a*, 122*b* extend from the planar surface 110 of the locking feature 34. When the encoder 28 is disposed within the stem 84 of the knob 30, the first and second locking projections 122*a*, 122*b* extend toward the stem 84. The first and second locking projections 122*a*, 122*b* are each compressed into a retention aperture 124 defined by the planar surface 110. Thus, the locking aperture 34 defines a friction fit with the encoder 28 and the stem 84 to hold the encoder 28** in place.

The encoder 28 is positioned within the receiving cavity 32 of the stem 84 and engages the locking feature 34 to securely couple the knob 30 to the encoder 28. Specifically, when the encoder 28 is within the locking feature 34, the first and second resilient ribs 114, 116 extend from the generally bowed construction to a straightened construction between the first and second rims 118, 120 to define a rigid structure of the locking feature 34 within the stem 84. This rigid structure of the locking feature 34 retains the encoder 28 within the stem 84 as a result of the straightened construction of the first and second resilient ribs 114, 116. In addition, the first and second locking projections **122*a*, 122*b* are flexed against the flat surface 98 of the stem 84 by the pressure from the encoder 28 being positioned within the receiving cavity 32 of the locking feature 34 and the stem 84. The first and second locking projections 122*a*, 122*b* are compressed toward each of the respective retention apertures 124, such that the retention aperture 124 of each of the first and second locking projections 122*a*, 122*b* is generally sealed against the planar surface 110 of the locking feature 34 and the flat surface 98 of the stem 84. Thus, as the encoder 28 is positioned within the locking feature 34, the locking feature 34 flexes against the stem 84 and the encoder 28 to frictionally engage the encoder 28 and rigidly couple the locking feature 34 to the knob 30**.

In addition to the friction fit within the stem 84, the locking feature 34 is further coupled to the encoder 28 via an adhesive 126. It is generally contemplated that the adhesive 126 may be disposed on the planar surface 110 of the locking feature 34 to couple the encoder 28 to the knob 30. While the generally flexible yet rigid construction of the locking feature 34 is configured to retain the encoder 28 within the receiving cavity 32 of the stem 84, the adhesive 126 further couples the encoder 28 to the locking feature 34 within the knob 30. The adhesive 126 is disposed on the planar surface 110 of the locking feature 34. The encoder 28 is disposed within the locking feature 34 and engages the adhesive 126 on the planar surface 110. Thus, the encoder 28 is securely coupled to the locking feature 34 and the locking feature 34 is rigidly compressed against the stem 84 of the knob 30 to retain the encoder 28 and the locking feature 34 within the receiving cavity 32 of the knob 30.

With reference again to FIGS. 1-9, the rigid engagement between the locking feature 34, the knob 30, and the encoder 28 minimizes the potential of the knob 30 to be removed from the encoder 28, and consequently, be removed from the user interface 12 as a whole. The coupling of the locking feature 34 to the encoder 28 minimizes potential removal of the knob 30 from the user interface 12, such that during potential cleaning of the appliance 10, a user may be prevented from removing the knob 30. Thus, the user may be prevented from accidental fluid damage of the electromechanical switch 26. The addition of the adhesive 126 further ensures that the knob 30 is securely coupled to the encoder 28 to minimize potential removal of the knob 30 from the user interface 12.

In addition, the collar 86 of the cap 82 along with the flange 18 form the barrier 80 further prevents potential fluid ingress within the receiving body 20 of the drainage assembly 54. Furthermore, where fluid may be present within the drainage assembly 54, potentially as a result of condensation build-up between the knob 30 and the drainage assembly 54, the configuration of the drainage channel 24 and the drip edge 66 directs the fluid away from the electromechanical switch 26. This configuration further minimizes the potential for fluid contact with the electromechanical switch 26. Specifically, the arrangement of the notch 60 defined by the flange 18 and the drip edge 66 of the receiving body 20 extending beyond the surface 68 of the housing 72 of the electromechanical switch 26 directs any potential fluid within the drainage assembly 54 away from the electromechanical switch 26.

The invention disclosed herein is further summarized in the following paragraphs and is further characterized by combinations of any and all of the various aspects described therein.

According to one aspect of the present disclosure, an appliance includes a user interface that has a first surface and an opposing second surface. A flange outwardly extends from the first surface. A receiving body extends from the opposing second surface and defines an encoder opening and a drainage channel. An electromechanical switch has an encoder that extends through the encoder opening that is defined by the receiving body. A knob is operably coupled to the electromechanical switch via the encoder. The knob defines a receiving cavity, and a locking feature is disposed within the receiving cavity and secures the knob to the encoder.

According to another aspect, a receiving body defines a drip edge that is proximate to a drainage channel.

According to yet another aspect, a drip edge is angled and directs a fluid from a receiving body away from an electromechanical switch.

According to still another aspect, a drip edge is disposed below an encoder opening and extends beyond a surface of an electromechanical switch.

According to yet another aspect, a flange defines a notch that has a crest configured to direct a fluid toward a drainage channel away from an electromechanical switch.

According to another aspect, an adhesive is disposed on a planar surface of a locking feature. The adhesive is configured to couple a knob to an encoder.

According to still another aspect, a flange directs a fluid from a first surface toward a drainage channel of a receiving body.

According to another aspect of the present disclosure, a user interface includes a front panel that has an exterior surface and an interior surface. A flange outwardly extends from the exterior surface and defines a notch. A receiving body extends from the interior surface of the front panel that is proximate the flange. A receiving body has an angled edge and defines a drainage channel that extends through a portion of the notch that is defined by the flange.

According to yet another aspect, a notch directs a fluid into a drainage channel of a receiving body.

According to still another aspect, an angled edge is a drip edge that is disposed within a drainage channel.

According to another aspect, an electromechanical switch is coupled to a receiving body. A drainage channel and an angled edge extends past the electromechanical switch and directs a fluid away from the electromechanical switch.

According to yet another aspect, a knob encircles a flange and has a stem that includes a locking feature.

According to still another aspect, a flange and a receiving body are integrally formed to define a drainage assembly. The drainage assembly has a circumferential sidewall that defines the flange and the receiving body.

According to yet another aspect, a circumferential sidewall defines a passage that extends to a drainage channel.

According to yet another aspect of the present disclosure, a user interface for an appliance includes a panel that has a first surface and an opposing second surface. A drainage assembly is coupled to the panel and extends from the first surface and the opposing second surface. The drainage assembly includes a receiving body that defines an opening and a drip edge. An encoder extends through the opening of the drainage assembly. A knob is operably coupled to the encoder and has a cavity. A locking feature is disposed within the cavity.

According to another aspect, a locking feature has a planar surface and an arcuate surface that is defined by first and second rims. The locking feature is configured to receive an encoder.

According to still another aspect, an adhesive is disposed on a planar surface of a locking feature and is configured to couple an encoder to a knob.

According to another aspect, a drainage assembly further includes a flange that is outwardly extending from a first surface.

According to yet another aspect, a knob is disposed around a flange to define a barrier around an encoder.

According to another aspect, a receiving body of a drainage assembly defines a notch that extends to a drip edge to define a drainage channel.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance comprising:

a user interface having a first surface and an opposing second surface;

a flange outwardly extending from the first surface;

a receiving body extending from the opposing second surface and defining an encoder opening, a drainage channel, and a drip edge proximate to the drainage channel;

an electromechanical switch having an encoder that extends through the encoder opening defined by the receiving body, wherein the drip edge extends beyond a surface of the electromechanical switch and is configured to minimize fluid contact with the electromechanical switch;

a knob operably coupled to the electromechanical switch via the encoder, the knob defining a receiving cavity; and a locking feature disposed within the receiving cavity and securing the knob to the encoder.

2. The appliance of claim 1, wherein the drip edge is angled and directs a fluid from the receiving body away from the electromechanical switch.

3. The appliance of claim 2, wherein the drip edge is disposed below the encoder opening and extends beyond the surface of the electromechanical switch.

4. The appliance of claim 1, wherein the flange defines a notch having a crest configured to direct a fluid toward the drainage channel away from the electromechanical switch.

5. The appliance of claim 4, further comprising:

an adhesive disposed on a planar surface of the locking feature, the adhesive configured to couple the knob to the encoder.

6. The appliance of claim 1, wherein the flange directs a fluid from the first surface toward the drainage channel of the receiving body.

7. A user interface, comprising:

a front panel having an exterior surface and an interior surface;

a flange outwardly extending from the exterior surface and defining a notch; and a receiving body extending from the interior surface of the front panel proximate the flange, the receiving body having an angled edge and defining a drainage channel that extends through a portion of the notch defined by the flange, wherein the angled edge directs a fluid away from the receiving body.

8. The user interface of claim 7, wherein the notch directs the fluid into the drainage channel of the receiving body.

9. The user interface of claim 7, wherein the angled edge is a drip edge disposed within the drainage channel.

10. The user interface of claim 7, further comprising:

an electromechanical switch coupled to the receiving body, wherein the drainage channel and the angled edge extend past the electromechanical switch and directs a fluid away from the electromechanical switch.

11. The user interface of claim 10, wherein a knob encircles the flange and has a stem that includes a locking feature.

12. The user interface of claim 7, wherein the flange and the receiving body are integrally formed to define a drainage assembly, the drainage assembly having a circumferential sidewall that defines the flange and the receiving body.

13. The user interface of claim 12, wherein the circumferential sidewall defines a passage that extends to the drainage channel.

14. A user interface for an appliance, comprising:

a panel having a first surface and an opposing second surface;

a drainage assembly coupled to the panel and extending from the first surface and the opposing second surface, the drainage assembly including a receiving body that defines an opening and an angled drip edge that directs a fluid away from the receiving body;

an encoder extending through the opening of the drainage assembly; and a knob operably coupled to the encoder and having a cavity, and a locking feature disposed within the cavity.

15. The user interface of claim 14, wherein the locking feature has a planar surface and an arcuate surface defined by first and second rims, and wherein the locking feature is configured to receive the encoder.

16. The user interface of claim 15, further comprising:

an adhesive disposed on the planar surface of the locking feature and configured to couple the encoder to the knob.

17. The user interface of claim 14, wherein the drainage assembly further includes a flange outwardly extending from the first surface.

18. The user interface of claim 17, wherein the knob is disposed around the flange to define a barrier around the encoder.

19. The user interface of claim 14, wherein the receiving body of the drainage assembly defines a notch that extends to the angled drip edge to define a drainage channel.

* * * * *